United States Patent [19]

Ladd, Jr.

[11] Patent Number: 4,630,954

[45] Date of Patent: Dec. 23, 1986

[54] COSMETIC POWDER DISPENSER AND APPLICATOR

[75] Inventor: James E. Ladd, Jr., Rowayton, Conn.

[73] Assignee: Laura Lupton, Inc, Rowayton, Conn.

[21] Appl. No.: 779,484

[22] Filed: Sep. 25, 1985

Related U.S. Application Data

[63] Continuation-in-part of Ser. No. 752,133, Jul. 5, 1985.

[51] Int. Cl.[4] ..... A46B 11/00; A46B 11/04

[52] U.S. Cl. ..... 401/123; 132/81; 132/82 R; 132/82 G; 401/82; 401/99; 401/125; 401/191; 401/270; 401/281

[58] Field of Search ..... 401/82, 99, 135, 270, 401/281, 123, 124, 125, 191, 83; 132/82 R, 82 G, 81

[56] References Cited

U.S. PATENT DOCUMENTS

| | | | |
|---|---|---|---|
| 206,791 | 8/1878 | Hopfen | 401/83 |
| 1,172,293 | 2/1916 | Kohlhepp | 132/82 G |
| 1,274,697 | 8/1918 | Dynowsky | 401/123 X |
| 1,588,633 | 6/1926 | Taylor | 401/123 X |
| 2,480,331 | 8/1949 | Lecker | 401/125 |

FOREIGN PATENT DOCUMENTS

| | | | |
|---|---|---|---|
| 897714 | 3/1945 | France | 401/83 |

*Primary Examiner*—Steven A. Bratlie

[57] ABSTRACT

A hollow elongated capsule containing cosmetic powder slides removably into an open end of a first elongated hollow member. The other end of the first member has a plurality of spaced openings. A second hollow elongated member has one end with like openings which is engaged to the other end of the first member. These two members have a first position of relative rotation at which the openings are aligned and a second position at which these openings are out of alignment. A third elongated hollow member has an open end detachably engaging the opposite end of the second member. A brush having parallel bristles with powder applying tips is disposed in the third member with the tips disposed adjacent the second member. The brush and third member have manually operated cooperating elements for establishing a first forward position at which the bristles extend almost entirely out of the third member, a third withdrawn position at which the brush is disposed within the third member and a second forward position at which the brush is disposed intermediate the first and third positions.

4 Claims, 8 Drawing Figures

COSMETIC POWDER DISPENSER AND APPLICATOR

CROSS REFERENCE TO COPENDING APPLICATION

This application is a continuation-in-part of copending application entitled "Cosmetic Powder Dispenser and Applicator", filed July 5, 1985, Ser. No. 752,133 now allowed.

BACKGROUND OF THE INVENTION

The copending application Ser. No. 752,133 discloses a cosmetic powder dispenser and applicator which employs a brush having a withdrawn position at which it is not in use and a forward position at which the brush bristles are fully extended and charged with cosmetic powder whereby the user can apply the powder as desired. However, the applicator can be used to dispense either cosmetic face powder or another type of cosmetic powder called blush. The face powder is applied to relatively large areas of the face. Blush is applied in small relatively sharply defined areas. Experimentally, it has been found that the fully extended bristle position, while excellent for applying face powder, is not suitable for applying blush. The present invention is directed toward a new modification of the dispenser and applicator disclosed in the aforesaid copending application in which both face powder and blush can be suitably dispensed and applied.

SUMMARY OF THE INVENTION

In accordance with the principles of the invention, a cosmetic powder dispenser and applicator employs a first elongated hollow member having first and second opposite ends. The first end is open. The second end is closed and has a plurality of small spaced apart openings therein. An elongated capsule adapted to be filled with face powder or blush is closed at one end and open at the other. The capsule is removably slidable into and out of the first member. The capsule, when inserted in the first member, has its open end adjacent the second end of the first member and its closed end closing the first end of the first member.

A second hollow elongated member has a first end with a like plurality of like openings and a second open end, the second member rotatably engaging the first member with the first end of the second member adjacent the second end of the first member. The first and second members have a first position of relative rotation at which the openings in the two members are aligned and a second position of relative rotation at which the openings in the two members are out of alignment.

A third elongated hollow member has an open end detachably engaging the second end of the second member and has an opposite closed end. A brush has a plurality of essentially parallel bristles with powder tips. The brush is disposed in the third member with said tips adjacent the second member. The brush and the third member have manually operated cooperating elements for establishing a first forward position at which the bristles extend almost entirely out of the third member, a second forward position at which the bristles extend somewhat outwardly of the third member, but not as fully extended as in the first position, and a third withdrawn position at which the brush is disposed within the third member.

When face powder is to be dispensed and applied, the brush should be in the first forward position. Face powder can be best applied with the bristles extending almost entirely out of the third member, since relatively large areas can be covered uniformly, quickly and easily. However, when blush is to be applied, the brush should be in the second forward position. The reduced amount of bristle extension makes the bristles somewhat stiffer and more controllable for blush application onto smaller, more sharply defined areas. The brush, in the third withdrawn position, is stored for future use.

In use, the dispenser and applicator is disposed vertically with the first member disposed above the second member and the brush is disposed within the third member. The first and second members are then placed into the first position of relative rotation whereby, when powder is in the capsule, the powder flows downwardly through the aligned holes onto the tips of the bristles. When sufficient powder has been applied to the tips, the two members are placed into the second position of relative rotation whereby the flow of powder ceases. The third member is then detached from the second member and the brush is moved into either the first forward position, if the capsule contains face powder, or into the second forward position, if the capsule contains blush. By using the third member as a handle, the user can apply the powder as needed.

It will be apparent that, in this manner, only the tips of the bristles are charged with powder, permitting a more accurate control of the position and thickness of the powder application and avoiding mess and lack of control otherwise caused when powder is carried through the body of the brush before reaching the tips of the bristles.

DETAILED DESCRIPTION OF PREFERRED EMBODIMENTS

Figures 1, 2, 3, 4, 5, 6, 7, 8:
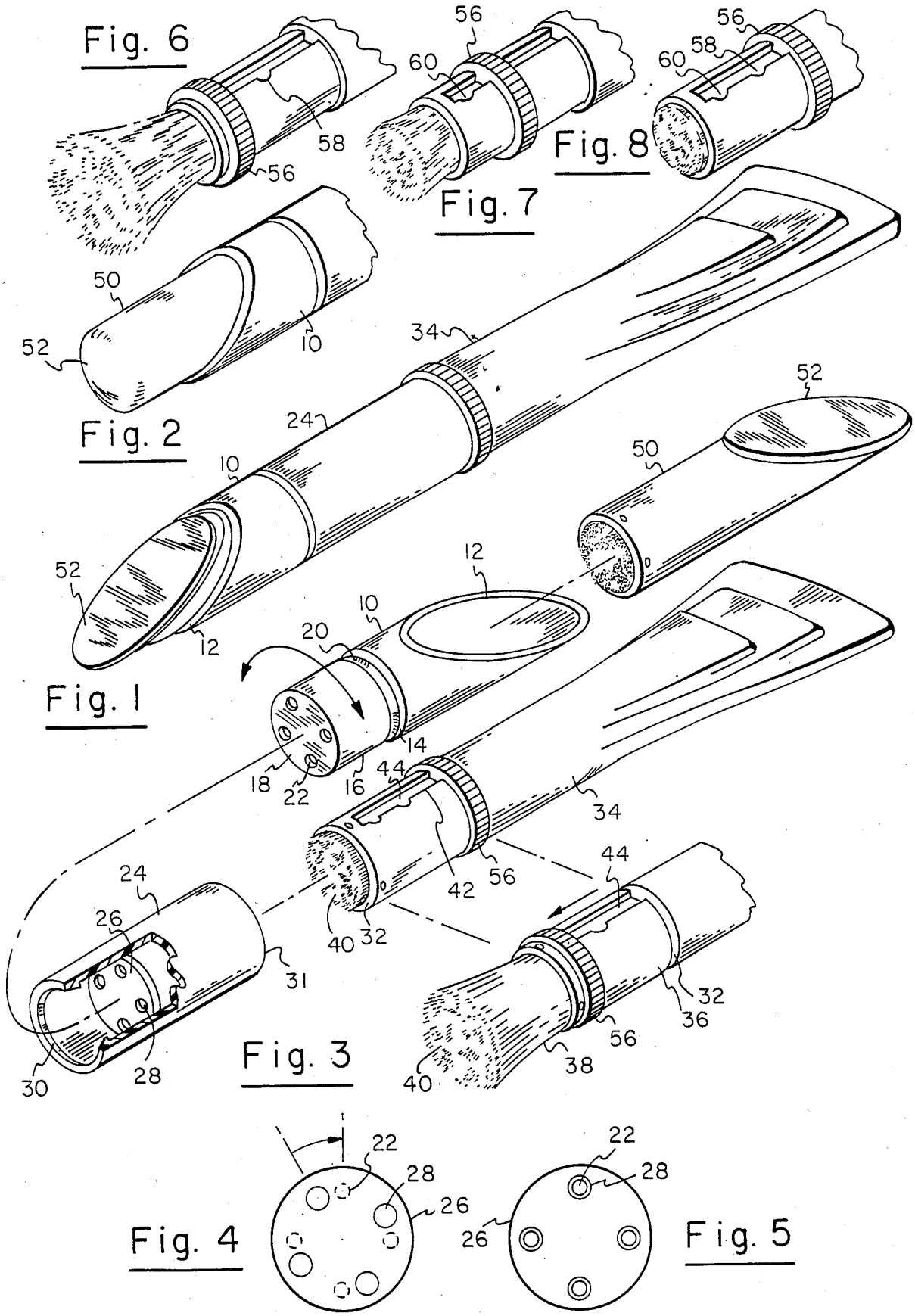
FIG. 1 is a perspective view of one embodiment of the invention.
FIG. 2 is a detail perspective view of a modification of the embodiment shown in FIG. 1.
FIG. 3 is an exploded view of the structure shown in FIG. 1.
FIG. 4 is a detail view of the openings in different parts of the embodiment of FIG. 1 as shown in out of alignment position.
FIG. 5 is a view similar to FIG. 4, but showing the openings in aligned position
FIGS. 6, 7 and 8 illustrate three different brush positions.

Referring first to FIGS. 1 and 3–8, a first elongated hollow cylindrical plastic member 10 has one open end 12 which lies in a plane disposed at an acute angle with respect to the direction of elongation and has the shape of an ellipse. Member 10 has a shoulder 14 intermediate the ends and an extension of smaller diameter 16 which terminates in the opposite end 16 of this member. End 18 is closed and has a plurality of spaced apart small openings 22 therein. That portion of extension 16 adjacent the shoulder 14 has a circular groove 20 cut therein.

A second elongated hollow cylindrical member 24 has a recessed closed end 26 with a like plurality of openings 28 spaced apart in like manner therein. Member 23 engages extension 16 whereby end 26 abuts end 18. The inner surface of the outer portion of the recessed end carries a lip 30 which rides in the groove 20 so that member 24 is secured to member 10 but is manually rotatable thereabout. These two members have a first position of relative rotation at which each of openings 22 is aligned with a corresponding one of openings 28 (FIG. 5) and a second position at which each of openings 22 is out of alignment with a corresponding opening 28 (FIG. 4). Suitable markings on the outer surfaces of the two members placed adjacent the abutting ends or other conventional means enables the user to place these members in either desired position. The opposite end 31 of member 24 is open.

A third hollow elongated plastic member 34 has one open end 32 and an opposite closed end. End 32 can be removably inserted into end 31. A brush with essentially parallel bristles 38 having tips 40 is slidably disposed in the open end 32 of member 34. That portion of member 34 adjacent end 32 has two oppositely disposed longitudinally extending slots 42, only one of which is visible in the drawing. The outer surface of the brush has two oppositely disposed elongated runners 44, each runner riding in a corresponding slot 42. The runners are secured at one end to ring 56 which is also the base for the bristles. Slots 42 each have two linearly spaced openings 58 and 60 disposed on each side of the slot in opposite aligned position. The ring can engage either of these openings.

When the ring is moved to engage member 34, the brush is slid rearward into the third withdrawn position as shown in FIG. 3 and FIG. 8. When the ring engages openings 60, the brush is slid forward and is detachably engaged in the first forward position as shown in FIG. 3 and FIG. 6. When the ring engages openings 58, the brush is slid forward and is detachably engaged in the second forward position as shown in FIG. 7. The second position is midway between the first and third positions. The positions of the slots and runners are such that the brush is always secured to member 34 which can act as a brush handle.

A hollow elongated plastic capsule 50 can be filled with cosmetic powder and slidably and removably inserted into member 10 via its open end. The capsule has a closed transparent end 52 which meets the open end of member 10 in flush engagement. The opposite end of the capsule is open and abuts the opposite closed end of member 10. Since end 52 is transparent, the user can determine visually how much powder remains to be used. The capsule can contain face powder or blush. The structure can then be used as previously described.

As shown in FIG. 2, the closed end of the capsule can extend beyond the open end of member 10 and need not have the same shape as this open end. The open end of course need not be elliptically shaped and need not lie in a place in the manner previously described. For example, this opening can be circular and lie in a plane a right angles to the direction of elongation.

What is claimed is:

1. A cosmetic powder dispenser and applicator comprising:

a first elongated hollow member having first and second opposite ends, the first end being open, the second end having a plurality of small spaced apart openings therein and being otherwise closed;

a hollow elongated capsule adapted to be filled with cosmetic powder, either face powder or blush, said capsule being closed at one end and open at the other, the capsule being removably slidable into and out of the first member and when inserted in the first member, having its open end adjacent the second end of the first member and its closed end closing the first end of the first member;

a second elongated hollow member having a first end with a like plurality of like openings and a second open end, the second member rotatably engaging the first member with the first end of the second member adjacent the second end of the first member, the first and second members having a first position of relative rotation at which the openings in the two members are aligned and a second position of relative rotation at which the openings in the two members are out of alignment;

a third elongated hollow member having an open end detachably engaging the second end of the second member and having an opposite closed end; and a brush having a plurality of essentially parallel bristles with powder applying tips, the brush being disposed in the third member with the tips adjacent the second member, said brush and said third member having manually operated cooperating means for establishing a first forward position when the capsule contains face powder at which the bristles will extend almost entirely out of the third member, a second forward position when the capsule contains blush at which the bristles extend out of the third member to a lesser extend then when the first position is used, and a third withdrawn position at which the brush is disposed within the third member.

2. The dispenser and applicator of claim 1 wherein the second position is midway between first and third positions.

3. The dispenser and applicator of claim 2 wherein the brush can be detachably engaged into either one of the first and second positions.

4. The dispenser and applicator of claim 3 wherein the means includes slots having openings which define the first and second brush positions.

* * * * *